US007096708B2

(12) United States Patent
Gascoin

(10) Patent No.: US 7,096,708 B2
(45) Date of Patent: Aug. 29, 2006

(54) FIXING SYSTEM FOR MOUNTING AND DISMOUNTING A BENDING TOOL

(75) Inventor: Eric Gascoin, Luynes (FR)

(73) Assignee: Amada Europe, Paris (FR)

( * ) Notice: Subject to any disclaimer, the term of this patent is extended or adjusted under 35 U.S.C. 154(b) by 233 days.

(21) Appl. No.: 10/779,310

(22) Filed: Feb. 12, 2004

(65) Prior Publication Data

US 2004/0163442 A1 Aug. 26, 2004

(30) Foreign Application Priority Data

Feb. 21, 2003 (FR) ..... 03 02187

(51) Int. Cl.
*B21D 37/14* (2006.01)

(52) U.S. Cl. ..... 72/482.91; 72/482.2; 72/481.1

(58) Field of Classification Search ..... 72/481.1, 72/481.2, 482.2, 482.91
See application file for complete search history.

(56) References Cited

U.S. PATENT DOCUMENTS 5,022,256 A * 6/1991 van der Meulen ..... 72/482.91
6,644,090 B1 * 11/2003 Gasparini ..... 72/482.2
2003/0005744 A1 1/2003 Gasparini
2004/0103710 A1 * 6/2004 Gascoin et al. ..... 72/482.2

FOREIGN PATENT DOCUMENTS

DE 3524694 A1 1/1987

OTHER PUBLICATIONS

FA631755/FR0302187 Sep. 5, 2003 Search Rpt.

* cited by examiner

*Primary Examiner*—Derris H. Banks
*Assistant Examiner*—Debra Wolfe
(74) *Attorney, Agent, or Firm*—Lucas & Mercanti, LLP

(57) ABSTRACT

A fixing system for mounting and dismounting a bending tool relative to the top panel of a bending press, in which the bending tool is held clamped between a first clamping surface of a tool spacer and a pivotally-mounted clamp including a second clamping surface. The system further comprises a tool-retaining member comprising a plurality of blades, each blade comprising a first elastically-deformable branch secured in part to the clamp, at least one angled portion, and a second elastically-deformable branch pointing upwards, with the end thereof being suitable for penetrating into a retaining groove situated in the bending tool, and being suitable for co-operating with the bottom edge of the groove when the tool pivots.

10 Claims, 3 Drawing Sheets

FIXING SYSTEM FOR MOUNTING AND DISMOUNTING A BENDING TOOL

The present invention relates to a fixing system for mounting and dismounting a bending tool on the top panel of a bending press.

BACKGROUND OF THE INVENTION

Bending presses are used to form sheet materials, and for that purpose they comprise one or more tools commonly referred to as "punches" fixed on the moving panel of the machine by means of a tool carrier or fixing system, and facing the tools, bending presses comprise one or more V-shaped dies that are fixed to the top edge of the bottom panel of the machine.

By placing the sheet that is to be formed on the die and lowering the punch through a predetermined distance, the sheet is bent through the desired angle.

In addition, depending on the type of forming and on the dimension of the forming to be implemented on the sheet materials, different tools are used. It is therefore necessary to be able to dismount the tool from the top panel, i.e. from the fixing system, so as to replace it with some other tool that is more suitable.

As is well known, the tool includes a fixing shank and it is fixed by means of a pivotally-mounted clamp capable of occupying a first position in which it clamps the tool or a second position which is spaced apart therefrom and allows the tool to be changed.

It should also be understood that bending tools are relatively heavy. It is therefore very desirable to hold the tool against the clamp even when it is in its loose position so as to avoid any danger of the tool dropping onto the die of the bottom panel placed facing the tool.

In French patent application FR 00/07415 in the name of the Applicant, an embodiment of a tool carrier or tool-fixing system is described that enables pivoting of the clamp to be controlled effectively and that also enables the tool to be retained after the clamp has been loosened.

Accompanying FIGS. 1A and 1B show the embodiment of the tool-fixing system described in the above-identified patent application. These figures show the moving top panel 10 and the tool spacer 12 fixed by any appropriate means to the top panel 10. The tool spacer has a bottom portion 14 of reduced thickness, defined by two shoulders 16 and 18.

The fixing system also has a clamp 20 mounted to pivot about a horizontal axis parallel to the long direction of the panel. The pivot axis may be defined by rocker-headed screws 22 co-operating with corresponding holes 24 machined in the middle portion 26 of the clamp 20. To pivot the clamp 20 about the axis defined by the heads of the rocker-headed screws 22, it is possible to use pushers 28 each having one end acting on the top end 30 of the clamp 20 and a second end co-operating with a rotary cam 32 mounted in the tool spacer 12 and extending in the longitudinal direction of the panel. In that embodiment, when the cam 32 is in the position shown in FIG. 1A, it causes the top portion 30 of the clamp to move away, which corresponds to the clamping position. In contrast, when the cam 32 is in its position shown in FIG. 1B, it no longer acts against the pushers 28, and under the effect of a resilient system, the clamp 20 takes up the mounting and dismounting position for the tool as shown in FIG. 1B.

In its top portion, the tool 34 has a fixing shank 36 which presents a first fixing surface 36*a*, a second fixing surface 36*b* parallel to the first fixing surface, and a retaining groove 38 situated beneath the second fixing surface 36*b* and presenting top and bottom edges 38*a* and 38*b*.

In the clamping position shown in FIG. 1A, the fixing surfaces 36*a* and 36*b* of the tool shank are clamped between the clamping surface 14*a* of the end 14 of the tool spacer and the clamping surface 40 of the bottom portion 42 of the clamp 20.

In addition, at its bottom end 42, the clamp includes retaining means in the form of a catch 44 capable of penetrating into the groove 38 of the shank of the tool 34. When the clamp 20 is in the clamping position as shown in FIG. 1A, the catch 44 does not perform any function. In contrast, when the bottom end 42 of the clamp is spaced apart to occupy the mounting and dismounting position, the catch 44 remains engaged in part in the groove 38, as shown in FIG. 1B, thereby enabling the tool 34 to be held in the vertical direction relative to the tool spacer 12.

That system enables the tool to be retained effectively and prevents it from falling, nevertheless it suffers from the following drawback. When the clamp 20 is brought into its mounting and dismounting position, the tool 34 can be removed only via one of the longitudinal ends of the clamp 20 by sliding the shank of the tool between the clamp and the bottom portion 14 of the tool spacer.

It will be understood that since the tool cannot be put into place between the bottom portion of the tool spacer and the clamp other than sideways, i.e. it can only be put into place via an end of the clamp, when the operator seeks to replace a tool which is mounted in the central portion of the clamp, for example, it is necessary for the operator to begin by removing all of the tools placed between the tool that actually needs to be changed and one of the ends of the clamp.

Such relatively difficult operations of removing a plurality of tools significantly increases the time required to change the desired tool, and thus reduces the productivity of the bending press. The greater the frequency with which tools need to be changed, the greater the loss of time.

Also known is a fixing system for a bending tool as described in U.S. Pat. No. 5,022,256 in the name of Machinefabriek Wila B. V. That system likewise comprises a tool spacer and a clamp mounted to pivot about a horizontal axis parallel to the long direction of the panel, with pivoting of the clamp being controlled by hydraulic actuators.

In addition, the system has an elastically-deformable metal strip mounted to pivot about a horizontal axis parallel to the long direction of the panel on the clamp and which presents a first surface facing the clamp and a second surface facing the bottom portion of the tool spacer. A rigid piece is fixed on the second surface, in the bottom portion of the metal strip. The rigid piece has a bottom portion presenting an inclined surface going towards the metal strip.

When the clamp is spaced apart to occupy the mounting and dismounting position for the tool, the metal strip is separated from the clamp and the top edge of the rigid piece co-operates with a shoulder formed on the fixing shank of the tool so as to prevent the tool from falling.

When the clamp is brought into the tool-clamping position, the fixing shank of the tool is clamped on one side by the bottom portion of the tool spacer and on the other by the rigid piece which transfers to the tool the force that is exerted thereon by the clamp.

The assembly constituted by the metal strip and by the rigid piece is thus subjected to very high compression stresses, thereby requiring materials that are capable of withstanding such stresses to be used for making these various parts and the fixing means for connecting the parts to one another.

In order to limit the stresses to which said assembly is subjected, U.S. Pat. No. 5,022,256 makes provision for placing a strip of flexible plastics material between the clamp and the metal strip, the plastics strip being housed in a groove formed in the clamp. That solution then presents the drawback of making the shape of the clamp more complex.

Furthermore, in that type of system, the elastically-deformable metal strip is subjected to compression stresses that are high and regularly repeated, causing it to lose its properties of elasticity progressively, which is harmful for proper operation of the system.

OBJECTS AND SUMMARY OF THE INVENTION

An object of the present invention is firstly to provide a system for fixing a tool to the top panel of a bending press which retains the principle of fixing the tool by clamping it between a clamping surface present on the spacer and a clamping surface present on the clamp, i.e. without any intermediate element situated between the clamp and the tool and being involved in clamping, and secondly a system enabling tools to be mounted and dismounted frontally relative to the top panel, so as to make it possible to change a desired tool on its own.

To achieve this object, the invention provides a system for fixing a bending tool, said tool having two fixing surfaces for fixing by clamping, and a retaining groove situated beneath one of the fixing surfaces and presenting top and bottom edges, the system comprising a clamping body having a first clamping surface suitable for co-operating with one of the fixing surfaces of the tool, and a pivotally-mounted tool clamp having a second clamping surface, said clamp being capable of occupying a tool-clamping first position in which the fixing surfaces of the tool are clamped between the first and second clamping surfaces, and a tool mounting and/or dismounting second position in which its second clamping surface is spaced apart from the first clamping surface of the clamping body.

The fixing system of the invention further comprises a tool-retaining member comprising a plurality of blades, each blade comprising:

- a first elastically-deformable branch secured in part to the clamp;
- a second elastically-deformable branch directed upwards and having an end suitable for penetrating into said retaining groove, and a portion suitable for co-operating with the bottom edge of said retaining groove when the tool pivots; and
- at least one angled portion located between said first and second elastically-deformable branches.

It will be understood that by virtue of the elasticity of the first and second branches, it is possible to install and withdraw the bending tool from the front face of the bending machine. Withdrawing the tool also requires co-operation between a portion of the second branch and the bottom edge of the groove in the tool. This operation occurs when the operator pulls on the tool, thus causing it to pivot about its top edge in contact with the clamping face of the tool spacer.

In addition, unlike the retaining member of U.S. Pat. No. 5,022,256 which has a rigid piece of considerable thickness, the retaining member of the fixing system of the invention comprises two elastically-deformable branches which enable the spacing of the clamp relative to the clamping face of the spacer to remain limited while a tool is being mounted and/or dismounted.

Advantageously, when the clamp is brought into the tool-dismounting position, the end of the second branch of the retaining member is capable of remaining engaged in said groove so as to retain the tool and avoid the tool dropping onto the bottom matrix of the bending press.

Once the clamp is in the dismounting position, the user can withdraw the tool by pulling it towards him in such a manner as to cause it to pivot. Under the effect of the tool pivoting, the assembly constituted by the two branches can deform so that the end of the second branch which was previously retaining the tool can become disengaged from said retaining groove.

In a particular embodiment of the invention, the end of said second branch forms an angle with the main portion thereof and/or the top edge of the retaining groove is chamfered. Said end can thus become disengaged from said groove more easily.

Advantageously, when the clamp is brought into its clamping position, said retaining member can exert on the tool a force with a vertical component so as to bring the tool into abutment against the tool spacer. This enables the tool to be properly positioned before beginning clamping. The user therefore no longer needs to perform this task and as a result any risk of accident is decreased.

Preferably, the end of said second branch is suitable for coming into abutment against the top edge of said retaining groove regardless of the position of the clamp. This makes it possible to retain the tool when the clamp is loosened and to exert a force on the tool during clamping.

Also preferably, the end of said first branch of the retaining member is secured to the outside surface of the clamp, opposite from said second clamping surface.

Such a disposition makes it easier to deform said first branch during clamping and/or while mounting and/or dismounting the tool.

Advantageously, the clamp of the fixing system of the invention includes a groove in its inside surface, i.e. the surface of the clamp facing the tool spacer. This groove extends along the direction of the clamp pivot axis and is suitable for receiving the end of the second branch when the tool pivots while it is being dismounted. This enables the second branch to be retained and thus prevents any pointless deformation of the retaining member while the tool is being withdrawn. This also serves to limit the spacing between the clamp and the clamping face of the spacer while mounting and/or dismounting the tool.

The system of the invention makes it possible to install or withdraw a tool on or from the top panel frontally, but it does not prevent proceeding with mounting and/or dismounting laterally. Under such circumstances, the user slides the tool between the clamping surface of the tool spacer and the retaining member, so that the ends of said second branches can penetrate into said retaining groove. Repeated use of the fixing system can lead to a small offset vertically between said ends, and that can be troublesome when mounting the tool laterally. To solve this additional problem, the end of each second branch presents a top edge of rounded shape so that the tool can slide easily from one branch to the other when the branches are not all at the same height.

BRIEF DESCRIPTION OF THE DRAWINGS

Other characteristics and advantages of the invention will be better understood on reading the following description of a preferred embodiment of the invention. The description refers to the accompanying drawings, in which.

MORE DETAILED DESCRIPTION

Figure 1A:
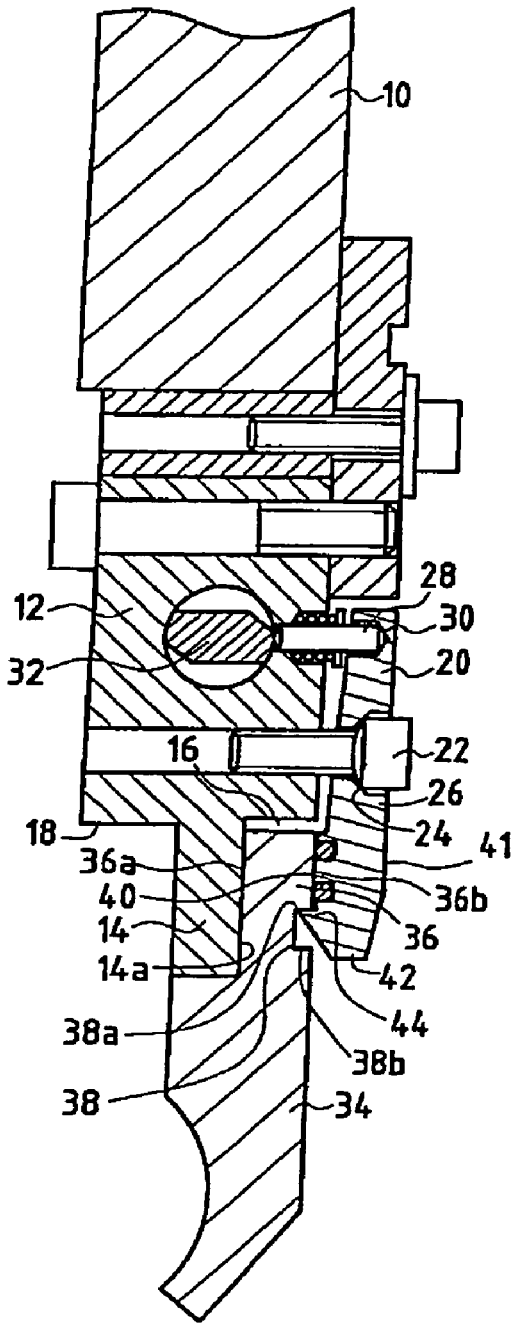
FIG.1A (Prior Art)
FIGS. 1A and 1B, described above, show a known type of system for fixing a bending tool both in its clamped position and in its mounting and/or dismounting position.
Figure 1B:
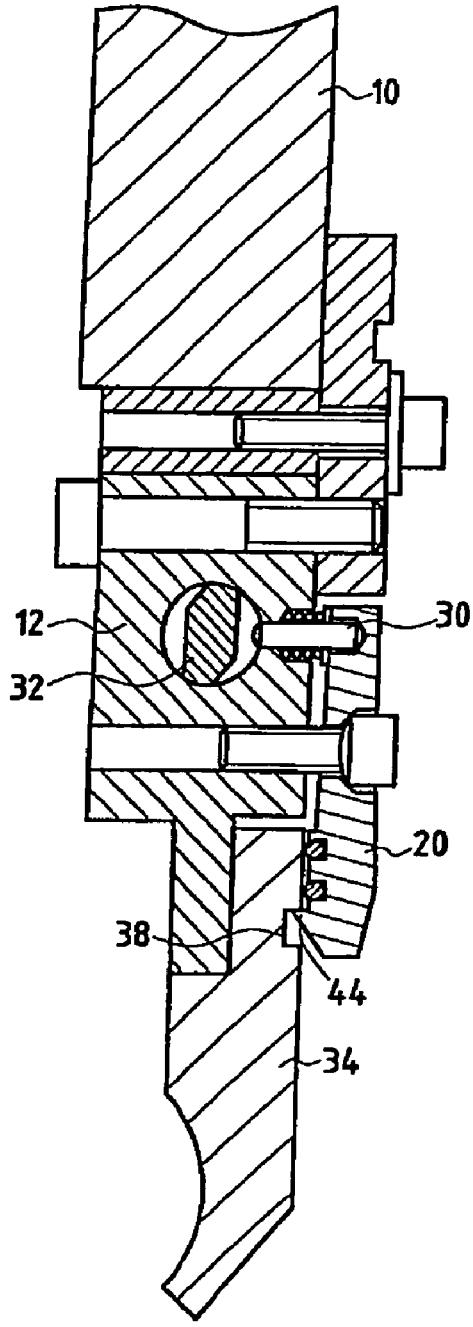
FIG.1B (Prior Art)
Figure 2:
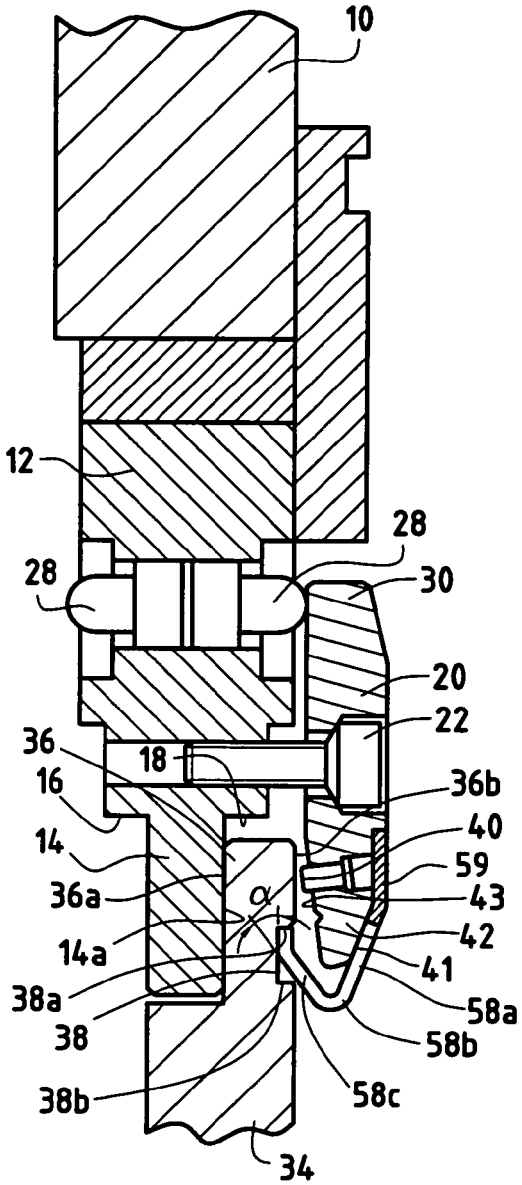
FIG. 2 shows a tool-fixing system of the invention in cross-section, the tool being installed but not clamped.

With reference initially to FIG. 2, there follows an overall description of the tool-fixing system. In FIG. 2, there can be seen the top panel 10 of the bending press, the tool spacer 12 with its bottom portion 14 of reduced width defined by the shoulders 16 and 18, the bottom portion 14 defining one of the clamping faces 14*a*. There can also be seen the clamp 20 with its top portion 30 and its bottom end 42. The pivot axis 22 for the clamp 20 is shown, as are the pushers 28 enabling each clamp to be pivoted about the axis 22. The way in which the axis 22 and the means for controlling clamp pivoting are embodied can be arbitrary, for example this can be done in the same manner as shown in FIGS. 1A and 1B.

In the fixing system shown, the shoulders 16 and 18 which define the bottom portion 14 of the spacer 12 are of the same size, and two pushers 28 are provided so that two clamps can be mounted on opposite sides of the spacer 12. This enables the user to mount the tool 34 regardless of its position relative to the remainder of the system.

It is important to observe at this point that the bottom end 42 of the clamp 20 does not have the retaining catch 44 of FIG. 1A.

FIG. 2 also shows the folding tool 34 with its fixing shank 36 and its retaining groove 38 presenting a top edge 38*a* and a bottom edge 38*b*. The fixing shank 36 has two fixing surfaces 36*a* and 36*b* suitable for co-operating respectively with the clamping surface 14*a* of the tool spacer and the clamping surface of the clamp 20. Said groove 38 is situated beneath the fixing surface 36*b* suitable for co-operating with the clamping surface of the clamp 20.

In the embodiment described, the bottom portion of the clamp 20, in its inside face facing towards the tool spacer, includes an insert which projects beyond the inside surface 43 and defines a clamping surface 40 that performs the same function as the clamping surface of the clamp shown in FIG. 1A.

It will be understood that the clamp 20 can pivot between a first fixing position in which the shank 36 of the tool is clamped between the clamping surface 14*a* of the extension 14 of the tool spacer and the clamping surface 40 of the clamp 20, and a second position of the clamp 20 for mounting and/or dismounting the bending tool 34 in which the clamping surface 40 is spaced apart from the shank 36 of the tool.

Figure 5:
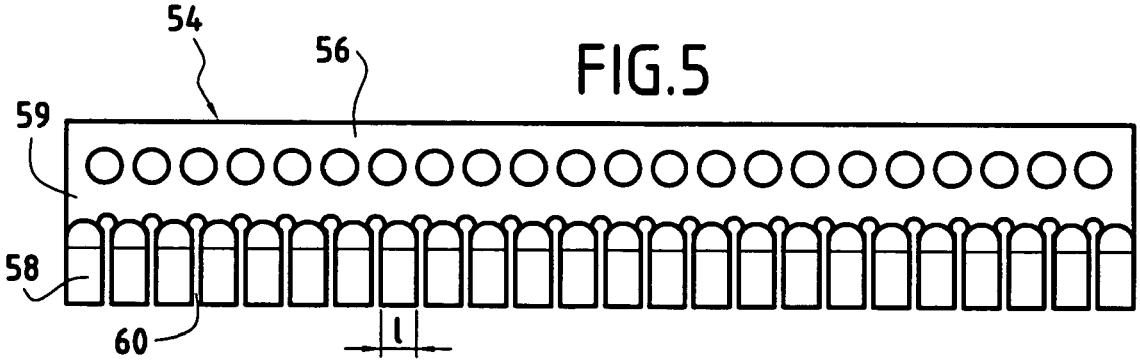
FIG. 5 is an elevation view of a preferred embodiment of the retaining member.

According to the invention, the bending tool is retained by a retaining member given overall reference 54 and shown in greater detail in FIG. 5. This retaining member 54 is preferably made of a sheet of elastically-deformable material 56 having elastically-deformable blades 58 defined therein. The elastically-deformable blades 58 are substantially identical, mutually aligned (i.e. aligned one with the other) and separated from one another by substantially parallel slots 60. The end of each blade 58 for penetrating into the groove 38 of the tool 34 preferably presents a rounded shape.

The width l of each elastically-deformable blade is determined in association with the length of the bending tools themselves in the long direction of the bending machine so that each blade 58 presses against the shank of only one bending tool.

Figure 3:
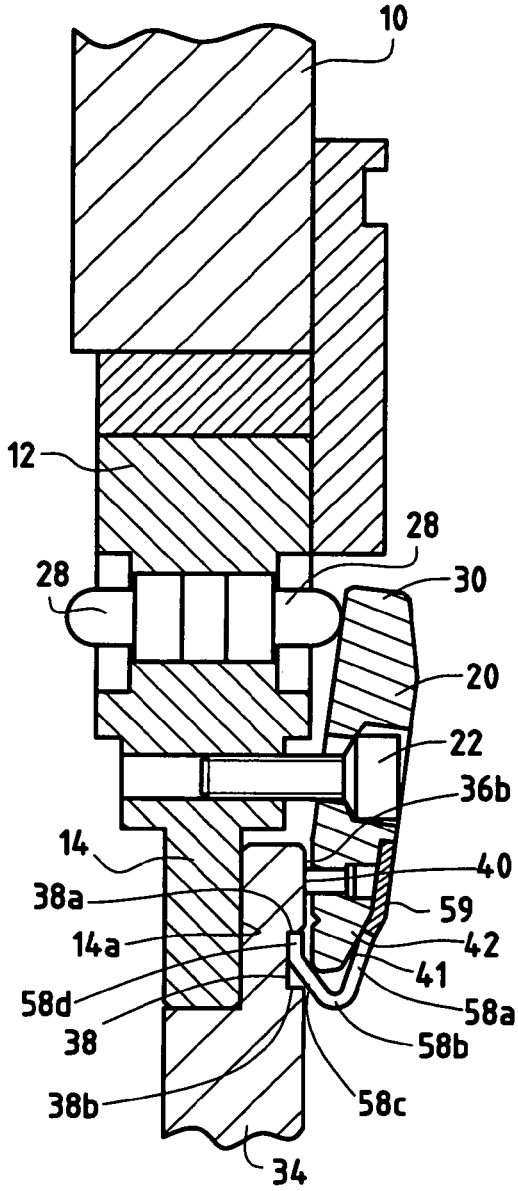
FIG. 3 shows the same fixing system, with the tool being clamped.

As can be seen better in FIG. 2, each blade 58 comprises: a first elastically-deformable branch 58*a* whose end 59 which is formed by the non-split portion of the elastically-deformable sheet is fixed by any suitable means to the surface 41 of the clamp 20 that is on the outside, i.e. its surface opposite from its clamping surface 40; an angled portion 58*b*; and a second elastically-deformable branch 58*c* pointing upwards and having an end 58*d* forming an angle $\alpha$ with the main portion of the branch, such that the end 58*d* is substantially parallel to the bottom of the groove 38 when the second branch 58*c* is engaged therein. As shown in FIG. 2, when the tool 34 is installed but not clamped, the end 58*d* of the second branch 58*c* comes into abutment against the top edge 38*a* of the retaining groove 38 so as to prevent the tool 34 from falling, and the first branch 58*a* is pressed substantially against the outside surface 41 of the end 42 of the clamp 20. When the tool 34 is clamped between the first and second clamping surfaces 14*a* and 40, said first branch 58*a* deforms and a portion of this branch then becomes spaced apart from the outside surface 41 of the clamp 20. By opposing such deformation, the first elastically-deformable branch 58*a* contributes to a force having a vertical component acting on the tool so as to bring the tool into abutment against the bottom portion 14 of the tool spacer 12, since the end 58*d* of the second branch 58*c* pushes against the top portion 38*a* of the groove 38. The tool 34 is thus properly positioned prior to clamping, as shown in FIG. 3.

Figure 4:
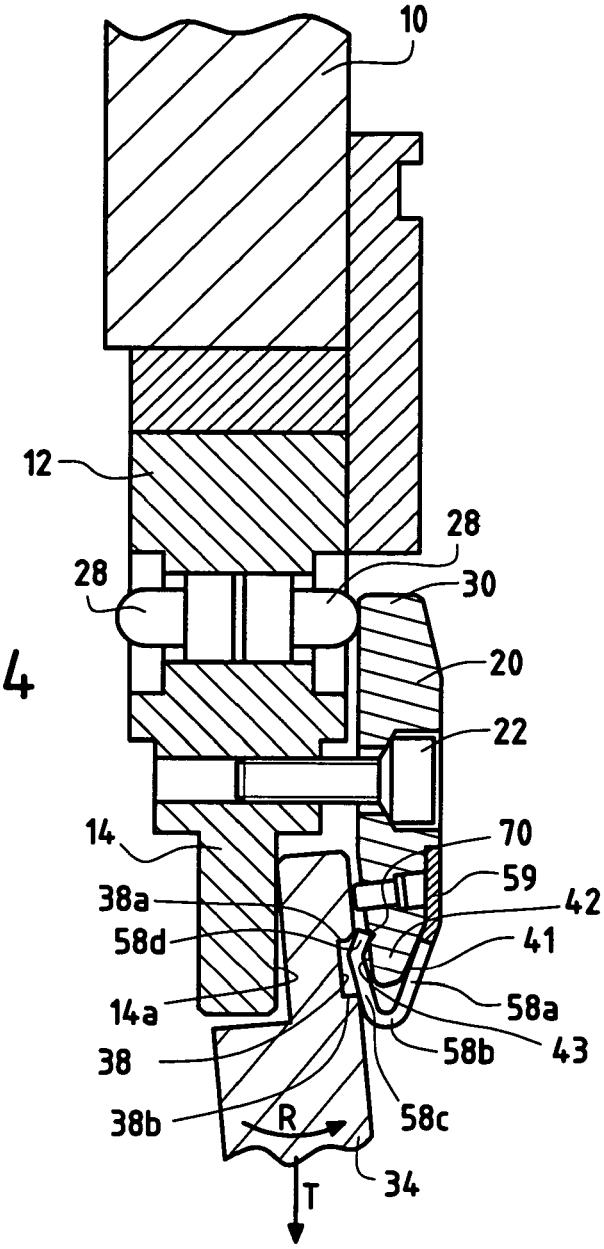
FIG. 4 shows the fixing system while said tool is being removed.

With reference to FIG. 4, when the clamp 20 is in the dismounting position, the user pulls the tool in the direction represented by arrow R towards the user so as to cause the tool to pivot about its top edge in contact with the clamping surface 14*a* of the spacer 12. The bottom portion 38*b* of the retaining groove 38 then pushes against the main portion of the second branch 58*c*. The first branch 58*a* then moves away a little from the outside surface 41 of the clamp. Under the combined effect of the force exerted by the bottom portion 38*b* of the groove and the deformation of the first branch 58*a* which seeks to return to its initial position, the end 58*d* of the second branch 58*c* disengages from the top portion 38*a* of the groove 38. To enable said end to disengage more easily from the groove, a chamfer is provided on the top portion 38*a* of the groove.

Once the end 58*d* has become disengaged, the user need only pull the tool 34 downwards in direction T. Provision can be made for a groove 70 formed in the inside surface 43 of the clamp 20 and extending along the direction of the clamp pivot axis, with the end 58*d* of the second branch 58*c* then being received in said groove while the tool is being withdrawn. Thus, the blade 58 is not entrained with the tool while it is being removed, thus presenting the advantage of avoiding any pointless deformation of the blade.

To put a new tool 34 into position, the user inserts the new tool frontally and from below, with the first and second branches then deforming so as to allow the tool to pass them, after which the end 58*d* of the second branch 58*c* penetrates into the retaining groove 38 as shown in FIG. 2. The tool 38 is then retained prior to being clamped.

What is claimed is:

1. A fixing system for fixing a bending tool, said tool having two fixing surfaces for fixing by clamping, and a retaining groove situated beneath one of the fixing surfaces, the groove presenting a top edge and a bottom edge, said system comprising:

a clamping body having a first clamping surface suitable for co-operating with one of the fixing surfaces of the tool, a pivotally-mounted tool clamp having a second clamping surface, said clamp being capable of taking up a tool-clamping first position in which said fixing surfaces of the tool are clamped between said first and second clamping surfaces, and a tool mounting and/or dismounting second position in which said second clamping surface of the clamp is spaced apart from said first clamping surface of the body; and a tool-retaining member comprising a plurality of blades, each blade comprising:

a first elastically-deformable branch secured in part to the clamp;

a second elastically-deformable branch directed upwards and having an end suitable for penetrating into said retaining groove, and a portion suitable for co-operating with the bottom edge of said retaining groove when the tool pivots; and at least one angled portion located between said first and second elastically-deformable branches, wherein when said clamp is brought into said tool-dismounting second position, said end of the second branch remains engaged in said retaining groove; and when said clamp is in the tool-dismounting second position, the assembly constituted by the two branches is suitable for deforming under the effect of the pivoting of the tool so that the end of the second branch becomes disengaged from said retaining groove.

2. A fixing system according to claim 1, wherein said second branch comprises a main portion and said end of the second branch forms an angle with said main portion.

3. A fixing system according to claim 1, wherein said top edge of the retaining groove is chamfered.

4. A fixing system according to claim 1, wherein:

when the clamp is brought into its clamping position, said retaining member exerts a force having a vertical component on the tool.

5. A fixing system according to claim 1, wherein the end of said second branch comes into abutment against the top edge of said retaining groove whatever the position of the clamp.

6. A fixing system according to claim 1, wherein said clamp has an outside surface opposite from said second clamping surface, and said first branch has an end which is secured to said outside surface of the clamp.

7. A fixing system according to claim 1, wherein the end of said second branch has a top edge of rounded shape.

8. A fixing system according to claim 1, wherein said clamp is pivotally-mounted around a pivot axis and has an inside surface provided with a groove, said groove extending along the direction of said clamp pivot axis and receiving the end of the second branch while the tool pivots.

9. A fixing system according to claim 1, wherein said retaining member is made out of elastically-deformable sheet material with said blades being mutually aligned.

10. A fixing system according to claim 9, wherein said blades are separated from one another by parallel slots.

* * * * *